US011718510B2

(12) United States Patent
Minami

(10) Patent No.: US 11,718,510 B2
(45) Date of Patent: Aug. 8, 2023

(54) CRANE AND CRANE CONTROL METHOD

(71) Applicant: TADANO LTD., Kagawa (JP)

(72) Inventor: Yoshimasa Minami, Kagawa (JP)

(73) Assignee: TADANO LTD., Kagawa (JP)

( * ) Notice: Subject to any disclaimer, the term of this patent is extended or adjusted under 35 U.S.C. 154(b) by 328 days.

(21) Appl. No.: 16/978,420

(22) PCT Filed: Mar. 13, 2019

(86) PCT No.: PCT/JP2019/010271
§ 371 (c)(1),
(2) Date: Sep. 4, 2020

(87) PCT Pub. No.: WO2019/177021
PCT Pub. Date: Sep. 19, 2019

(65) Prior Publication Data

US 2021/0039923 A1 Feb. 11, 2021

(30) Foreign Application Priority Data

Mar. 15, 2018 (JP) ..... 2018-048657

(51) Int. Cl.
*B66C 13/48* (2006.01)
*B66C 13/08* (2006.01)
(Continued)

(52) U.S. Cl.
CPC ..... *B66C 13/48* (2013.01); *B66C 13/085* (2013.01); *B66C 13/46* (2013.01); *B66C 23/36* (2013.01); *B66C 2700/0371* (2013.01)

(58) Field of Classification Search
CPC ..... B66C 13/063; B66C 13/22; B66C 13/46; B66C 13/085; B66C 13/48
See application file for complete search history.

(56) References Cited

U.S. PATENT DOCUMENTS 6,140,930 A * 10/2000 Shaw ..... B66C 13/46 340/685
9,346,656 B2 5/2016 May
(Continued)

FOREIGN PATENT DOCUMENTS

EP 1894881 A2 3/2008
JP H09-264736 A 10/1997
(Continued)

OTHER PUBLICATIONS

JP 2010/228905A Machine Translation (Year: 2010).*
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

The invention addresses the problem of providing a crane and a crane control method that can suppress load swaying when controlling an actuator on the basis of the load. The invention is provided with a turntable camera (7*b*) that detects the current position coordinates p(n) of a load W with respect to a reference position, wherein the invention: converts a target speed signal Vd to target position coordinates p(n+1) of the load W with respect to the reference position; calculates the current position coordinates q(n) of a boom (9) with respect to the reference position from a turning angle θz(n), a hoisting angle θx(n), and an extension/contraction length lb(n); calculates a feed amount l of the wire rope and the directional vector e(n) of the wire rope from the current position coordinates p(n) of the load W and the current position coordinates (n) of the boom (9); calculates the target position coordinates q(n+1) of the boom (9) with regards to the target position coordinates (n+1) of the load W from the feed amount l and the directional vector
(Continued)

e(n) of the wire rope; and generates an actuator operation signal Md on the basis of the target position coordinates q(n+1) of the boom (9).

5 Claims, 13 Drawing Sheets

(51) Int. Cl.
*B66C 13/46* (2006.01)
*B66C 23/36* (2006.01)

(56) References Cited

U.S. PATENT DOCUMENTS

2002/0175824 A1* 11/2002 Shaw ..... B66C 13/46 340/685
2003/0214415 A1* 11/2003 Shaw ..... B66C 15/06 340/685
2013/0013144 A1* 1/2013 Tanizumi ..... B66C 23/905 701/34.4
2013/0103271 A1* 4/2013 Best ..... B66C 13/40 701/50
2013/0161279 A1 6/2013 Schneider et al.
2015/0217976 A1* 8/2015 Tanizumi ..... B66C 13/00 703/2
2016/0119589 A1* 4/2016 Tanizumi ..... H04N 23/635 345/173

FOREIGN PATENT DOCUMENTS

JP H10-157957 A 6/1998
JP H10-157957 A 6/1998
JP 2010-228905 A 10/2010

OTHER PUBLICATIONS

Mar. 3, 2021 Indian Office Action issued for related IN application No. 202017038462.
Jun. 4, 2019, International Search Report issued for related PCT application No. PCT/JP2019/010271.
Jun. 4, 2019, International Search Opinion issued for related PCT application No. PCT/JP2019/010271.
Hayashi et al., Trajectory Planning of Rotary Crane Control Based on Inverse Dynamics, Sep. 15, 2005, pp. 1-3.

* cited by examiner

CRANE AND CRANE CONTROL METHOD

CROSS REFERENCE TO PRIOR APPLICATION

This application is a National Stage Patent Application of PCT International Patent Application No. PCT/JP2019/010271 (filed on Mar. 13, 2019) under 35 U.S.C. § 371, which claims priority to Japanese Patent Application No. 2018-048657 (filed on Mar. 15, 2018), which are all hereby incorporated by reference in their entirety.

TECHNICAL FIELD

The present invention relates to a crane and a method of controlling the crane.

BACKGROUND ART

Conventionally, as mobile cranes or the like, a crane in which actuators are remotely manipulated has been proposed. In such a crane, the relative positional relationship between the crane and a remote manipulation terminal changes according to a working situation. For this reason, an operator needs to manipulate manipulation tools of the remote manipulation terminal while keeping considering the relative positional relationship between the crane and the remote manipulation terminal. To meet this need, a remote manipulation terminal and a crane are known, which enable easy and simple manipulation of the crane by causing a manipulation direction of a manipulation tool of the remote manipulation terminal to match an operating direction of the crane regardless of the relative positional relationship between the crane and the remote manipulation terminal. For example, see Patent Literature (hereinafter, referred to as "PTL") 1).

A remote manipulation apparatus (remote manipulation terminal) described in PTL 1 transmits to a crane a laser beam or the like having high straightness as a reference signal. Control apparatus 31 on the crane side receives the reference signal from the remote manipulation apparatus to identify the direction of the remote manipulation apparatus, and causes the coordinate system of the crane to match the coordinate system of the remote manipulation apparatus. Thus, the crane is manipulated by a manipulative command signal from the remote manipulation apparatus that is generated with reference to a load. In other words, actuators of the crane are controlled based on commands on the moving direction of and moving speed of the load, and it is thus possible to intuitively manipulate the crane without paying attention to the operating speed, the operating amount, the operating timing, and the like of each of the actuators.

Based on the manipulative command signal of a manipulation section, the remote manipulation apparatus transmits, to the crane, a speed signal related to a manipulation speed and a directional signal related to a manipulation direction. Accordingly, in the crane, discontinuous acceleration is sometimes caused so as to swing the load at the start or stop of movement in which the speed signal from the remote manipulation apparatus is input in the form of a process function. Moreover, since the crane performs a control using the speed signal and the directional signal from the remote manipulation apparatus as a speed signal and a directional signal for the tip of a boom on the assumption that the tip of the boom is always vertically above the load, it is impossible to prevent the occurrence of a positional shift and/or a swing of the load caused by the influence of a wire rope.

CITATION LIST

Patent Literature

PTL 1

Japanese Patent Application Laid-Open No. 2010-228905

SUMMARY OF INVENTION

Technical Problem

An object of the present invention is to provide a crane and a method of controlling the crane which allow a load to move along a target course while reducing a swing of the load when an actuator is controlled with reference to the load.

Solution to Problem

The technical problem to be solved by the present invention is as described above, and a solution to this problem will be described next.

That is, the crane of the present invention is a crane that controls an actuator of a boom based on a target speed signal related to a moving direction and a speed of a load suspended from the boom by a wire rope, the crane including: a swivel angle detection means of the boom; a luffing angle detection means of the boom; an extension/retraction length detection means of the boom; and a load position detection means that detects a current position of the load relative to a reference position, in which it is preferable that the target speed signal is converted into a target position of the load relative to the reference position, a current position of a boom tip relative to the reference position is computed from a swivel angle detected by the swivel angle detection means, a luffing angle detected by the luffing angle detection means, and an extension/retraction length detected by the extension/retraction length detection means, a let-out amount of the wire rope is computed from the current position of the load detected by the load position detection means and the current position of the boom tip, a direction vector of the wire rope is computed from the current position of the load and the target position of the load, a target position of the boom tip for the target position of the load is computed from the let-out amount and the direction vector of the wire rope, and an operation signal for the actuator is generated based on the target position of the boom tip.

In the crane of the present invention, the target speed signal is converted into the target position of the load by integrating the target speed signal and attenuating a frequency component in a predetermined frequency range.

In the crane of the present invention, a relationship between the target position of the boom tip and the target position of the load is expressed by the following Equation 1 based on the target position of the load, a weight of the load, and a spring constant of the wire rope, and the target position of the boom tip is computed by the following Equation 2 that is a function of time for the load:

(Equation 1)

$$m\ddot{p}g=mg+f=mg+k_f(q-p) \quad [1]$$

(Equation 2)

$$q(t)=p(t)+l(t,\alpha)e(t)=q(p(t),\ddot{p}(t),\alpha) \quad [2]$$

wherein "f" denotes a tension of the wire rope, "kf" denotes the spring constant, "m" denotes a mass of the load, "q" denotes the current position or the target position of a tip of the boom, "p" denotes the current position or the target position of the load, "l" denotes the let-out amount of the wire rope, and "g" denotes gravitational acceleration.

The method of controlling a crane of the present invention is a method of controlling a crane that controls an actuator of a boom based on a target speed signal related to a moving direction and a speed of a load suspended from the boom by a wire rope, the method including: a target-course computation process of converting the target speed signal into a target position of the load; a boom-position computation process of computing a let-out amount of the wire rope from a current position of the load and a current position of a boom tip relative to a reference position, computing a direction vector of the wire rope from the current position of the load and the target position of the load, and computing a target position of the boom tip for the target position of the load from the let-out amount and the direction vector of the wire rope; and an operation-signal generation process of generating an operation signal for the actuator based on the target position of the boom tip.

Advantageous Effects of Invention

The present invention produces effects as described below.

In the crane and the method of controlling the crane of the present invention, the direction vector of the wire rope is computed from the current position and the target position of a load and the current position of the boom tip, and the target position of the boom tip is computed from the let-out length and the direction vector of the wire rope, so that the crane is manipulated with reference to the load, and the boom is controlled such that the load moves along the target course. It is thus possible to move the load along the target course while reducing the swing of the load, when controlling the actuator with reference to the load.

In the crane of the present invention, since the frequency component including a singular point caused by a differential operation for computation of the target position of the boom is attenuated, the boom is stably controlled. It is thus possible to move the load along the target course while reducing the swing of the load, when controlling the actuator with reference to the load.

In the crane of the present invention, an inverse dynamics model is constructed with reference to the load, the direction vector of the wire rope is computed from the current position of the load and the current position of the boom tip, and the target position of the boom for the target position of the load is computed from the let-out length and the direction vector of the wire rope, so that there is no error that could be caused in a transitional state during acceleration, deceleration, or the like. It is thus possible to move the load along the target course while reducing the swing of the load, when controlling the actuator with reference to the load.

DESCRIPTION OF EMBODIMENT

Hereinafter, crane 1 that is a mobile crane terrain crane) will be described as a working vehicle according to one embodiment of the present invention with reference to FIGS. 1 and 2. Note that, although the present embodiment will be described in relation to a crane (rough terrain crane) as a working vehicle, the working vehicle may also be an all-terrain crane, a truck crane, a truck loader crane, an aerial work vehicle, or the like.

Figure 1:
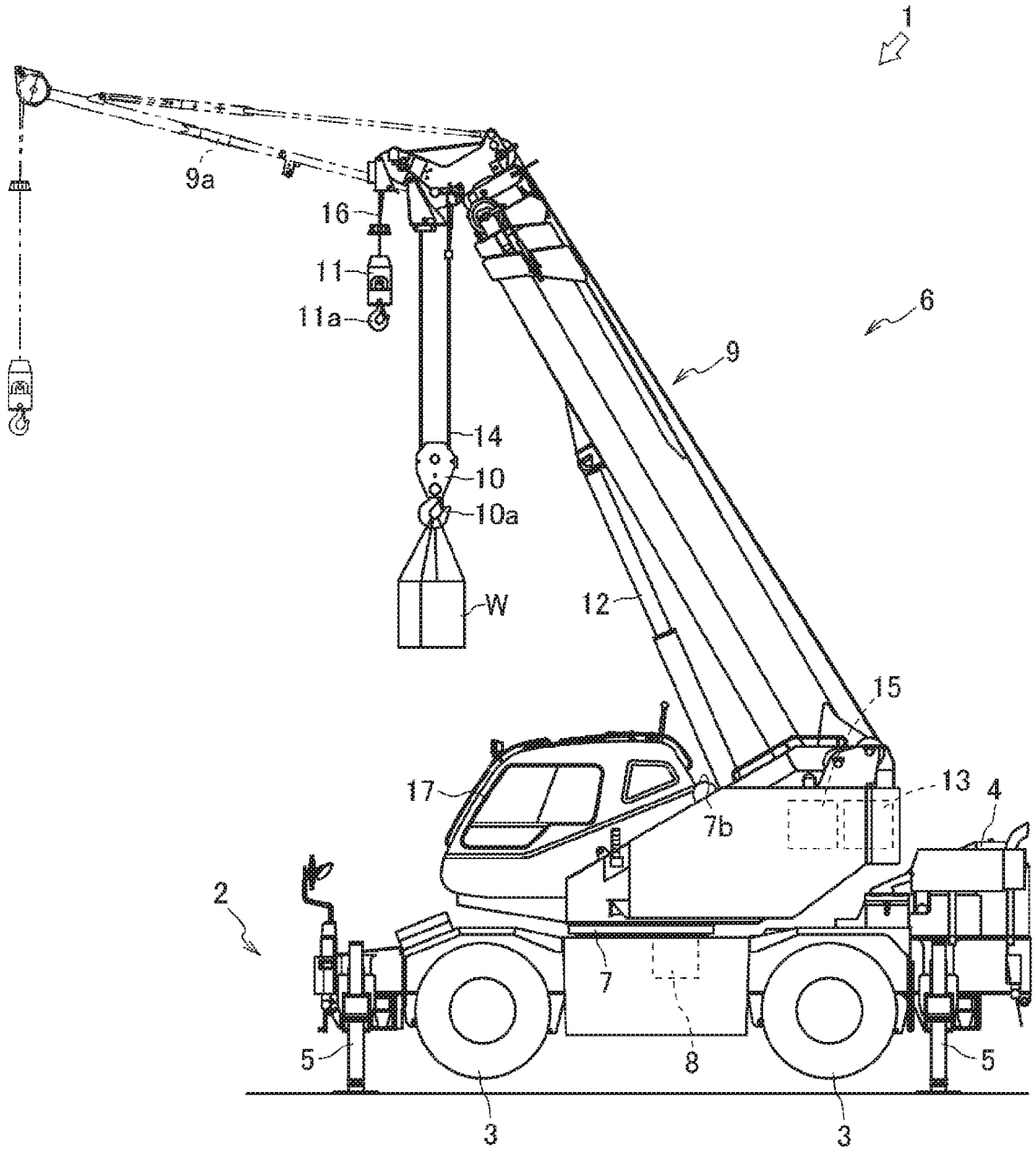
FIG. 1 is a side view illustrating an entire configuration of a crane.

As illustrated in FIG. 1, crane 1 is a mobile crane that can be moved to an unspecified place. Crane 1 includes vehicle 2, crane apparatus 6 that is a working apparatus, and remote manipulation terminal 32 (see FIG. 2) with which crane apparatus 6 is remotely manipulatable.

Vehicle 2 carries crane apparatus 6. Vehicle 2 includes a plurality of wheels 3, and travels using engine 4 as a power source. Vehicle 2 is provided with outriggers 5. Outriggers 5 are composed of projecting beams hydraulically extendable on both sides of vehicle 2 in the width direction and hydraulic jack cylinders extendable in the direction vertical to the ground. Vehicle 2 can extend a workable region of crane 1 by extending outriggers 5 in the width direction of vehicle 2 and bringing the jack cylinders into contact with the ground.

Crane apparatus 6 hoists up load W with a wire rope. Crane apparatus 6 includes swivel base 7, boom 9, jib 9*a*, main hook block 10, sub hook block 11, hydraulic luffing cylinder 12, main winch 13, main wire rope 14, sub winch 15, sub wire rope 16, cabin 17, and the like.

Swivel base 7 allows crane apparatus 6 to swivel. Swivel base 7 is disposed on a frame of vehicle 2 via an annular bearing. Swivel base 7 is configured to be rotatable around the center of the annular bearing serving as a rotational center. Swivel base 7 is provided with hydraulic swivel motor 8 that is an actuator. Swivel base 7 is configured to swivel in one and the other directions by hydraulic swivel motor 8.

Swivel-base cameras 7*b*, which are monitoring apparatuses, capture images of obstacles and people around swivel base 7. Swivel-base cameras 7*b* are disposed on both the left and right sides of the front of swivel base 7 and on both the left and right sides of the rear of swivel base 7. Swivel-base cameras 7*b* capture images of the periphery of where each of the swivel-base cameras is installed, to cover the entire circumference of swivel base 7 as a monitoring area. Further, swivel-base cameras 7*b* disposed respectively on both the left and right sides of the front of swivel base 7 are configured to be usable as a set of stereo cameras. In other words, swivel-base camera 7*b* at the front of swivel base 7 can be configured to be used as a set of stereo cameras, so as to serve as a load position detection means that detects positional information of suspended load W. Note that, the load position detection means may also be configured by boom camera 9*b* described below. The load position detection means may be any means such as a millimeter-wave radar, a GNSS apparatus, or the like which is capable of detecting the positional information of load W.

Hydraulic swivel motor 8 that is an actuator is manipulated to rotate by using swivel valve 23 (see FIG. 2) that is an electromagnetic proportional switching valve. Swivel valve 23 can control the flow rate of an operating oil supplied to hydraulic swivel motor 8 to any flow rate. That is, swivel base 7 is configured to be controllable via hydraulic swivel motor 8 manipulated to rotate by using swivel valve 23 such that the swivel speed of swivel base 7 is any swivel speed. Swivel base 7 is provided with swivel sensor 27 (see FIG. 2) that detects the swivel angle θz (angle) and swivel speed of swivel base 7.

Boom 9, which is a boom, supports the wire rope such that load W can be hoisted. Boom 9 is composed of a plurality of boom members. Boom 9 is disposed such that the base end of a base boom member can be swung at a substantial center of swivel base 7. Boom 9 is configured to be extendible and retractable in the axial direction by moving the boom members by a hydraulic extension/retraction cylinder (not illustrated) that is an actuator. In addition, boom 9 is provided with jib 9*a*.

The hydraulic extension/retraction cylinder (not illustrated) that is an actuator is manipulated to extend and retract by using extension/retraction valve 24 (see FIG. 2) that is an electromagnetic proportional switching valve. Extension/retraction valve 24 can control the flow rate of an operating oil supplied to the hydraulic extension/retraction cylinder to any flow rate. Boom 9 is provided with extension/retraction sensor 28 for detecting the length of boom 9 and vehicle-side azimuth sensor 29 for detecting an azimuth with respect to the tip of boom 9 as a center.

Boom camera 9*b* (see FIG. 2), which is a sensing apparatus, captures images of load W and of the features around load W. Boom camera 9*b* is disposed on the tip portion of boom 9. Boom camera 9*b* is configured to capture images of the features and topography around load W and crane 1 from vertically above load W.

Main hook block 10 and sub hook block 11 are for suspending load W. Main hook block 10 is provided with a plurality of hook sheaves around which main wire rope 14 is wound, and main hook 10*a* for suspending load W. Sub hook block 11 is provided with sub hook 11*a* for suspending load W.

Hydraulic luffing cylinder 12 that is an actuator luffs up or down boom 9, and holds the attitude of boom 9. In hydraulic luffing cylinder 12, an end of the cylinder part is swingably coupled to swivel base 7, and an end of the rod part is swingably coupled to the base boom member of boom 9. Hydraulic luffing cylinder 12 is manipulated to extend or retract by luffing valve 25 (see FIG. 2) that is an electromagnetic proportional switching valve. Luffing valve 25 can control the flow rate of an operating oil supplied to hydraulic luffing cylinder 12 to any flow rate. Boom 9 is provided with luffing sensor 30 (see FIG. 2) for detecting luffing angle θx.

Main winch 13 and sub winch 15 pull in (wind) or let out (unwind) main wire rope 14 and sub wire rope 16, respectively. Main winch 13 has a configuration in which a main drum around which main wire rope 14 is wound is rotated by using a main hydraulic motor (not illustrated) that is an actuator, and sub winch 15 has a configuration in which a sub drum around which sub wire rope 16 is wound is rotated by using a sub hydraulic motor (not illustrated) that is an actuator.

The main hydraulic motor is manipulated to rotate by main valve 26*m* (see FIG. 2) that is an electromagnetic proportional switching valve. Main winch 13 is configured to be capable of being manipulated, by controlling the main hydraulic motor using main valve 26*m*, such that the pulling-in and letting-out speeds are any speeds. Similarly, sub winch 15 is configured to be capable of being manipulated, by controlling the sub hydraulic motor using sub valve 26*s* (see FIG. 2) that is an electromagnetic proportional switching valve, such that the pulling-in and letting-out speeds are any speeds. Main winch 13 and sub winch 15 are provided with winding sensors 43 (see FIG. 2) for detecting let-out amounts l of main wire rope 14 and sub wire rope 16, respectively.

Cabin 17 covers an operator compartment. Cabin 17 is mounted on swivel base 7. Cabin 17 is provided with an operator compartment that is not illustrated. The operator compartment is provided with manipulation tools for traveling manipulation of vehicle 2, and swivel manipulation tool 18, luffing manipulation tool 19, extension/retraction manipulation tool 20, main-drum manipulation tool 21*m*, sub-drum manipulation tool 21*s*, and the like for manipulating crane apparatus 6 (see FIG. 2). Swivel hydraulic motor 8 is manipulatable with swivel manipulation tool 18. Luffing hydraulic cylinder 12 is manipulatable with luffing manipulation tool 19. The hydraulic extension/retraction cylinder is manipulatable with extension/retraction manipulation tool 20. The main hydraulic motor is manipulatable with main-drum manipulation tool 21*m*. The sub hydraulic motor is manipulatable with sub-drum manipulation tool 21*s*.

Communication device 22 (see FIG. 2) receives a control signal from remote manipulation terminal 32, and transmits control information or the like from crane apparatus 6. Communication device 22 is disposed in cabin 17. Communication device 22 is configured to transfer the control signal or the like to control apparatus 31 via a communication line (not illustrated) when receiving the control signal or the like from remote manipulation terminal 32. Further, communication device 22 is configured to transfer the control information from control apparatus 31, image i1 from swivel-base cameras 7*b*, and image i2 from boom camera 9*b* to remote manipulation terminal 32 via the communication line (not illustrated). Here, the control signal is a signal including at least one of a manipulation signal for controlling crane 1, target speed signal Vd, target course signal Td, operation signal Md, and the like.

Vehicle-side azimuth sensor 29, which is an azimuth detection means, detects an azimuth with respect to the tip of boom 9 of crane apparatus 6 as a center. Vehicle-side azimuth sensor 29 is composed of a triaxial type azimuth sensor. Vehicle-side azimuth sensor 29 detects terrestrial magnetism to compute the absolute azimuth. Vehicle-side azimuth sensor 29 is disposed at the tip portion of boom 9.

Figure 2:
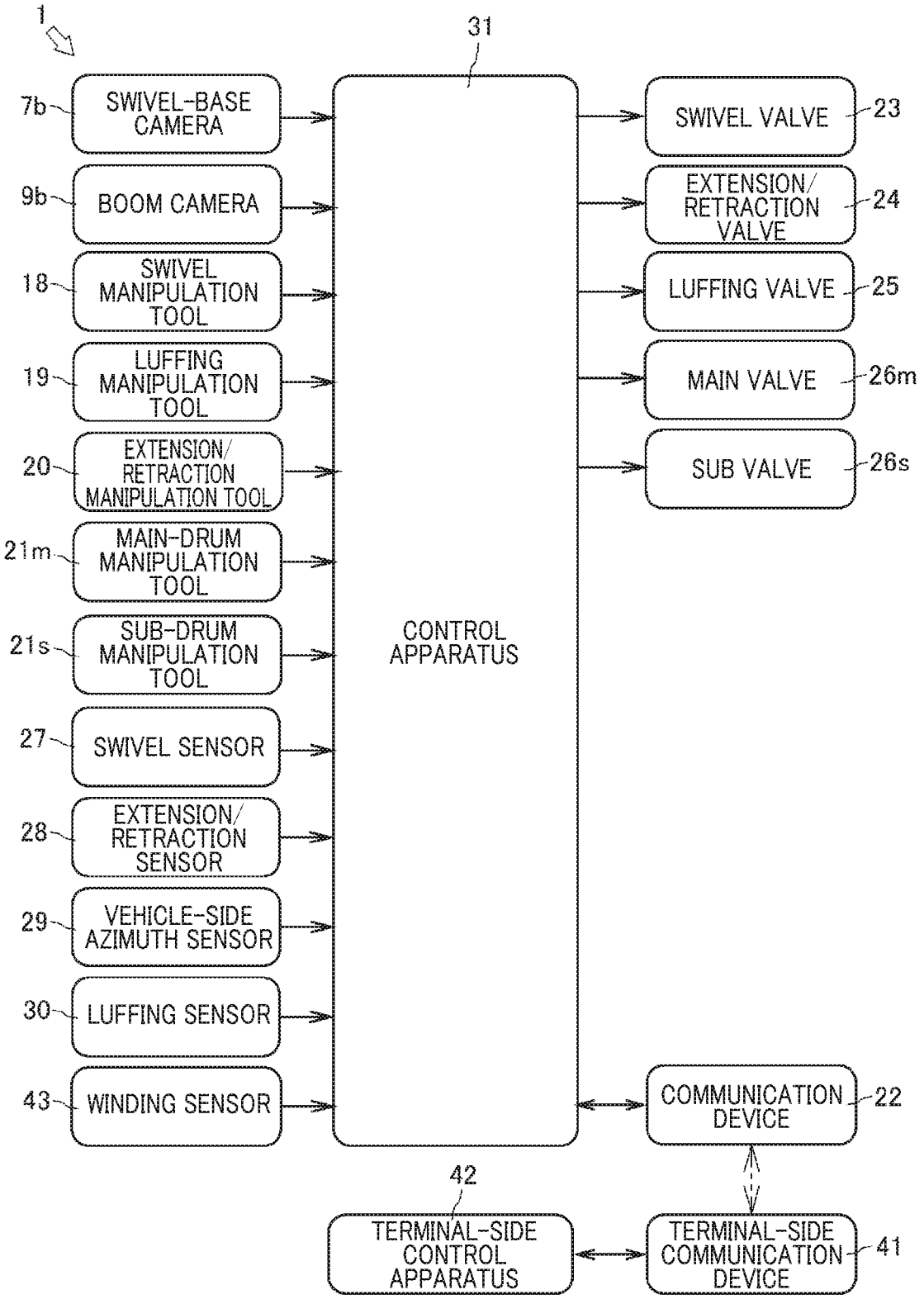
FIG. 2 is a block diagram illustrating a control configuration of the crane.

Control apparatus 31 controls the actuators of crane 1 via the manipulation valves as illustrated in FIG. 2. Control apparatus 31 is disposed inside cabin 17. Substantively, control apparatus 31 may have a configuration in which a CPU, ROM, RAM, HDD, and/or the like are connected to one another via a bus, or may be configured to consist of a one-chip LSI or the like. Control apparatus 31 stores various programs and/or data in order to control the operation of the actuators, the switching valves, the sensors, and/or the like.

Control apparatus 31 is connected to swivel-base cameras 7*b*, boom camera 9*b*, swivel manipulation tool 18, luffing manipulation tool 19, extension/retraction manipulation tool 20, main-drum manipulation tool 21*m*, and sub-drum manipulation tool 21*s*, and is capable of obtaining image i1 from swivel-base cameras 7*b*, image i2 from boom camera 9*b*, and the manipulation amount of each of swivel manipulation tool 18, huffing manipulation tool 19, main-drum manipulation tool 21*m*, and sub-drum manipulation tool 21*s*.

Control apparatus 31 is connected to communication device 22 to be capable of obtaining the control signal from remote manipulation terminal 32 and transmitting the control information from crane apparatus 6, image it from swivel-base cameras 7*b*, image i2 from boom camera 9*b*, and the like.

Control apparatus 31 is connected to swivel valve 23, extension/retraction valve 24, luffing valve 25, main valve 26*m*, and sub valve 26*s*, and is capable of transmitting operation signals Md to swivel valve 23, luffing valve 25, main valve 26*m*, and sub valve 26*s*.

Control apparatus 31 is connected to swivel sensor 27, extension/retraction sensor 28, vehicle-side azimuth sensor 29 and luffing sensor 30, and is capable of obtaining swivel angle θz of swivel base 7, extension/retraction length Lb, luffing angle θx, and an azimuth with respect to the tip of boom 9 as the center.

Control apparatus 31 generates operation signal Md corresponding to each of the manipulation tools based on the manipulation amount of each of swivel manipulation tool 18, luffing manipulation tool 19, main-drum manipulation tool 21*m*, and sub-drum manipulation tool 21*s*.

Crane 1 configured as described above is capable of moving crane apparatus 6 to any position by causing vehicle 2 to travel. Crane 1 is also capable of extending the lifting height and/or the operating radius of crane apparatus 6, for example, by luffing up boom 9 to any luffing angle θx with hydraulic luffing cylinder 12 by manipulation of luffing manipulation tool 19, and/or by extending boom 9 to any length of boom 9 by manipulation of extension/retraction manipulation tool 20. Crane 1 is also capable of carrying load W by hoisting up load W with sub-drum manipulation tool 21*s* and/or the like, and causing swivel base 7 to swivel by manipulation of swivel manipulation tool 18.

Next, remote manipulation terminal 32 will be described with reference to FIGS. 3, 4, 5A, and 5B.

Figure 3:
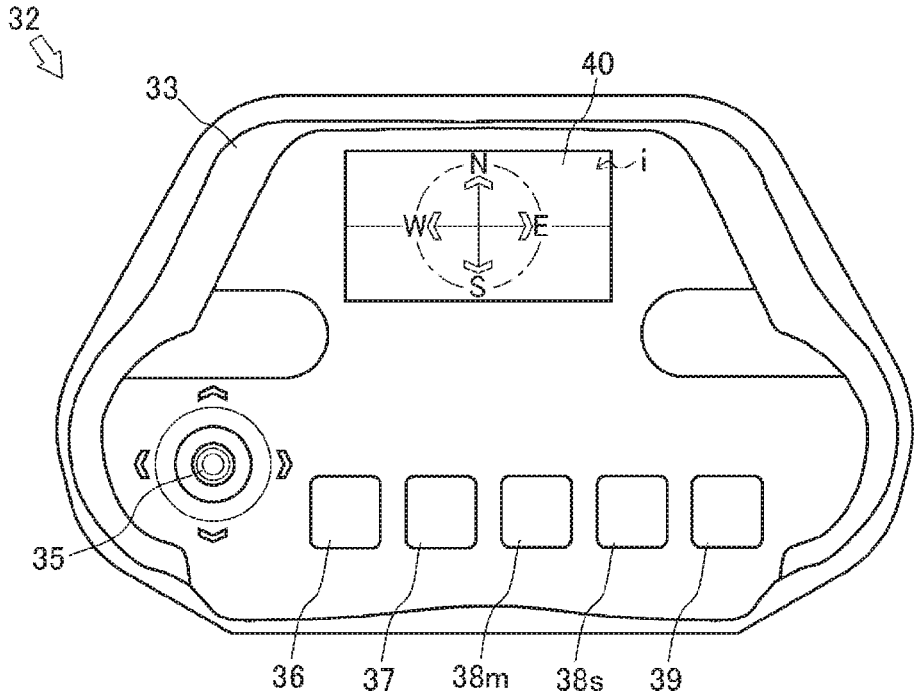
FIG. 3 is a plan view illustrating a schematic configuration of a remote manipulation terminal.

As illustrated in FIG. 3, remote manipulation terminal 32 is used for remote manipulation of crane 1. Remote manipulation terminal 32 includes: housing 33; terminal-side azimuth sensor 34 (see FIG. 4); suspended-load movement manipulation tool 35, terminal-side swivel manipulation tool 36, terminal-side extension/retraction manipulation tool 37, terminal-side main-drum manipulation tool 38*m*, terminal-side sub-drum manipulation tool 38*s*, terminal-side luffing manipulation tool 39, terminal-side display apparatus 40, terminal-side communication device 41, and terminal-side control apparatus 42 (see FIGS. 2 and 4) disposed on a manipulation surface of housing 33; and the like. Remote manipulation terminal 32 transmits to crane apparatus 6 target speed signal Vd of load W that is generated by manipulation of suspended-load movement manipulation tool 35 or any of the manipulation tools.

Housing 33 is a main component of remote manipulation terminal 32. Housing 33 is formed as a housing having a size that can be held by the operator's hand. Suspended-load movement manipulation tool 35, terminal-side swivel manipulation tool 36, terminal-side extension/retraction manipulation tool 37, terminal-side main-drum manipulation tool 38*m*, terminal-side sub-drum manipulation tool 38*s*, terminal-side luffing manipulation tool 39, terminal-side display apparatus 40, and terminal-side communication device 41 (see FIGS. 2 and 4) are installed on the manipulation surface of housing 33.

Terminal-side azimuth sensor 34, which is an azimuth detection means, detects an azimuth with reference to an upward direction in plan view of the manipulation surface of remote manipulation terminal 32 (hereinafter, such an upward direction is simply referred to as "upward direction"). Terminal-side azimuth sensor 34 is composed of a triaxial type azimuth sensor. Terminal-side azimuth sensor 34 detects terrestrial magnetism to compute the absolute azimuth. Terminal-side azimuth sensor 34 is disposed inside of housing 33.

Suspended-load movement manipulation tool 35 is a tool with which an instruction for moving load W at any speed in any direction in any horizontal plane is input. Suspended-load movement manipulation tool 35 is composed of a manipulation stick erected substantially vertically from the manipulation surface of housing 33 and a sensor (not illustrated) for detecting the tilt direction and the tilt amount of the manipulation stick. Suspended-load movement manipulation tool 35 is configured such that the manipulation stick can be manipulated to be tilted in any direction. Suspended-load movement manipulation tool 35 is configured to transmit to terminal-side control apparatus 42 a manipulation signal for the tilt direction and the tilt amount of the manipulation stick detected by the sensor (not illustrated).

Terminal-side swivel manipulation tool 36 is a tool with which an instruction for swiveling crane apparatus 6 at any moving speed in any moving direction is input. Terminal-side swivel manipulation tool 36 is composed of a manipulation stick erected substantially vertically from the manipulation surface of housing 33 and a sensor (not illustrated) for detecting the tilt direction and the tilt amount of the manipulation stick. Terminal-side swivel manipulation tool 36 is configured to be tillable in a direction for instructing left swivel and in a direction for instructing right swivel.

Terminal-side extension/retraction manipulation tool 37 is a tool with which an instruction for extension/retraction of boom 9 at any speed is input. Terminal-side extension/retraction manipulation tool 37 is composed of a manipulation stick erected from the manipulation surface of housing 33 and a sensor (not illustrated) for detecting the tilt direction and the tilt amount of the manipulation stick. Terminal-side extension/retraction manipulation tool 37 is configured to be tiltable in a direction for instructing extension and in a direction for instructing retraction.

Terminal-side main-drum manipulation tool 38*m* is a tool with which an instruction for rotating main winch 13 in any direction at any speed is input. Terminal-side main-drum manipulation tool 38*m* is composed of a manipulation stick erected from the manipulation surface of housing 33 and a sensor (not illustrated) for detecting the tilt direction and the tilt amount of the manipulation stick. Terminal-side main-drum manipulation tool 38*m* is configured to be tiltable in a direction for instructing winding of main wire rope 14 and in a direction for instructing unwinding of main wire rope 14. Terminal-side sub-drum manipulation tool 38*s* is similarly configured.

Terminal-side luffing manipulation tool 39 is a tool with which an instruction for luffing boom 9 at any speed is input. Terminal-side luffing manipulation tool 39 is composed of a manipulation stick erected from the manipulation surface of housing 33 and a sensor (not illustrated) for detecting the tilt direction and the tilt amount of the manipulation stick. Terminal-side luffing manipulation tool 39 is configured to be tiltable in a direction for instructing luffing up and in a direction for instructing luffing down.

Terminal-side display apparatus 40 is for displaying various information such as postural information of crane 1, information on load W, and/or the like. Terminal-side display apparatus 40 is configured by an image display apparatus such as a liquid crystal screen or the like. Terminal-side display apparatus 40 is disposed on the manipulation surface of housing 33. Terminal-side display apparatus 40 displays an azimuth with reference to the upward direction of remote manipulation terminal 32. The indication of the azimuth is rotationally displayed in conjunction with the rotation of remote manipulation terminal 32.

Figure 4:
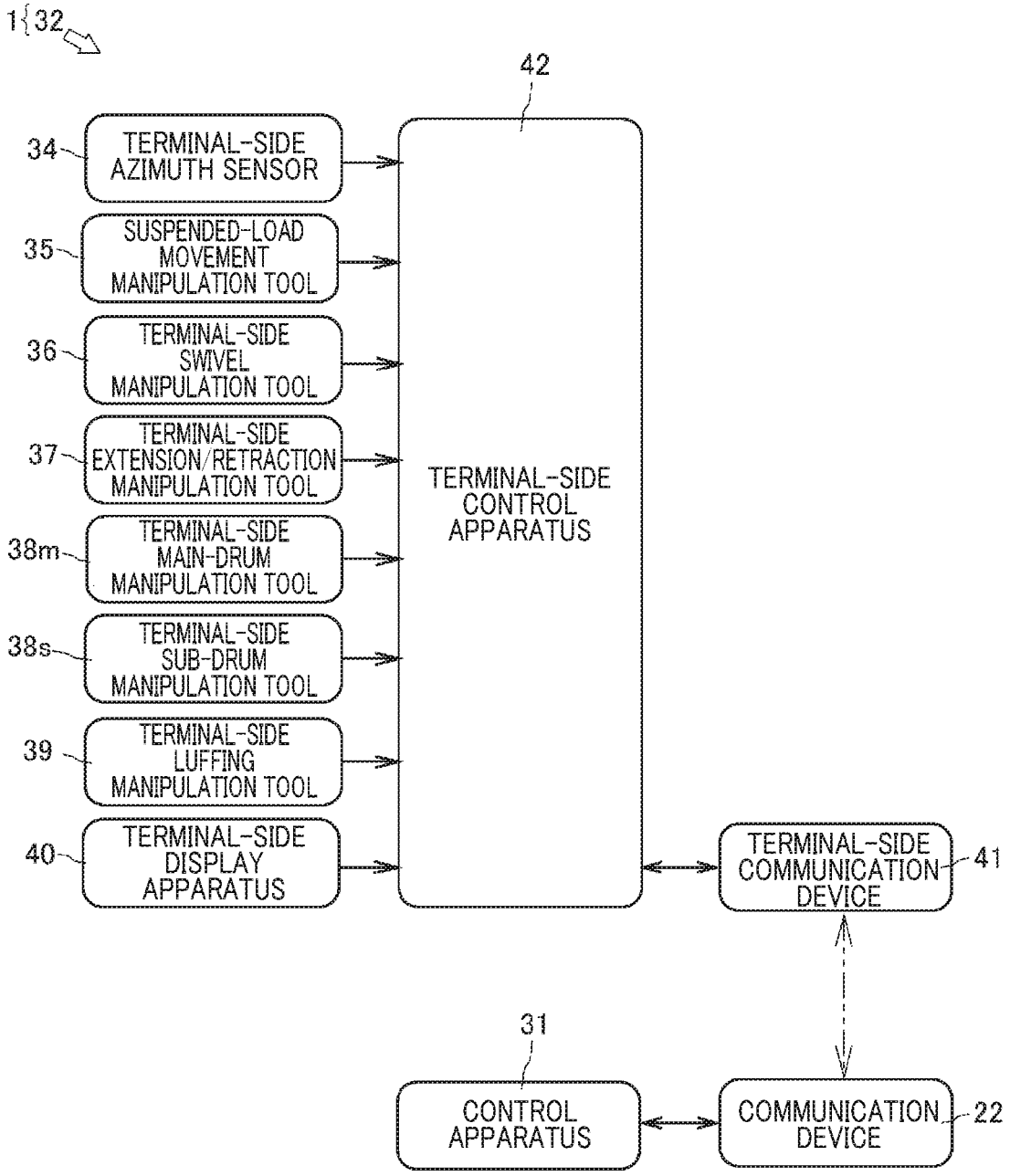
FIG. 4 is a block diagram illustrating a control configuration of the remote manipulation terminal.

As illustrated in FIG. 4, terminal-side communication device 41 receives the control information and the like of crane apparatus 6, and transmits the control information and the like from remote manipulation terminal 32. Terminal-side communication device 41 is installed inside housing 33. Terminal-side communication device 41 is configured to transmit, to terminal-side control apparatus 42, image i1, image i2, the control signal, and the like from crane apparatus 6 upon receiving the images, the control signal, and the like from crane apparatus 6. Terminal-side communication device 41 is also configured to transmit the control information, image i1 and image i2 from terminal-side control apparatus 42 to control apparatus 31 of crane 1.

Terminal-side control apparatus 42, which is a controller, controls remote manipulation terminal 32. Terminal-side control apparatus 42 is disposed inside housing 33 of remote manipulation terminal 32. Substantively, terminal-side control apparatus 42 may have a configuration in which a CPU, ROM, RAM, HDD, and/or the like are connected to one another via a bus, or may be configured to consist of a one-chip LSI or the like. Terminal-side control apparatus 42 stores various programs and data in order to control the operation of suspended-load movement manipulation tool 35, terminal-side azimuth sensor 34, terminal-side swivel manipulation tool 36, terminal-side extension/retraction manipulation tool 37, terminal-side main-drum manipulation tool 38*m*, terminal-side sub-drum manipulation tool 38*s*, terminal-side luffing manipulation tool 39, terminal-side display apparatus 40, terminal-side communication device 41, and the like.

Terminal-side control apparatus 42 is connected to terminal-side azimuth sensor 34, and is capable of obtaining an azimuth detected by terminal-side azimuth sensor 34.

Terminal-side control apparatus 42 is connected to suspended-load movement manipulation tool 35, terminal-side swivel manipulation tool 36, terminal-side extension/retraction manipulation tool 37, terminal-side main-drum manipulation tool 38*m*, terminal-side sub-drum manipulation tool 38*s*, and terminal-side luffing manipulation tool 39, and is capable of obtaining a manipulation signal including the tilt direction and the tilt amount of the manipulation stick of each of the manipulation tools.

Terminal-side control apparatus 42 can generate target speed signal Vd of load W from the manipulation signal of the manipulation stick obtained from the sensor of each of terminal-side swivel manipulation tool 36, terminal-side extension/retraction manipulation tool 37, terminal-side main-drum manipulation tool 38*m*, terminal-side sub-drum manipulation tool 38*s*, and terminal-side luffing manipulation tool 39.

Terminal-side control apparatus 42 is connected to terminal-side display apparatus 40, and is capable of causing terminal-side display apparatus 40 to display image i1, image i2, and various information from crane apparatus 6. Terminal-side control apparatus 42 is also capable of causing the terminal-side display apparatus to rotationally display the indication of the azimuth in association with the azimuth obtained from terminal-side azimuth sensor 34. Terminal-side control apparatus 42 is connected to terminal-side communication device 41, and is capable of transmitting and receiving various information to and from communication device 22 of crane apparatus 6 via terminal-side communication device 41.

Figure 5A:
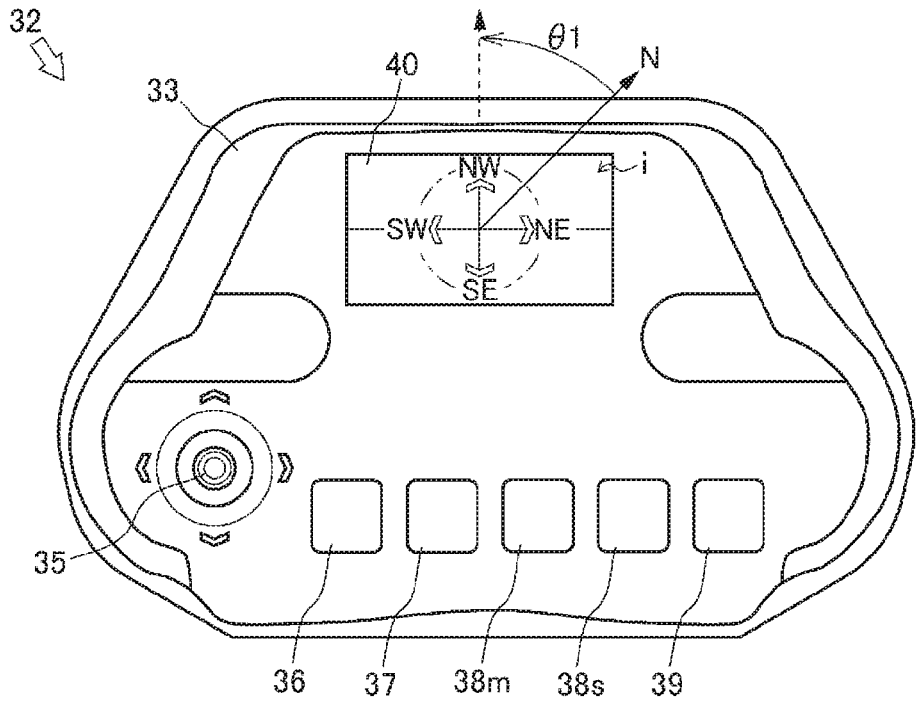
FIG. 5A illustrates an azimuth of a manipulation direction in a case where the orientation of the remote manipulation terminal is changed.

As illustrated in FIG. 5A, terminal-side control apparatus 42 (see FIG. 4) sets an azimuth with reference to the upper direction of remote manipulation terminal 32 based on the azimuth obtained from terminal-side azimuth sensor 34 (see FIG. 4). For example, when the upper direction of remote manipulation terminal 32 pointing in the north direction is rotated leftward by θ1=45°, the upper direction of remote manipulation terminal 32 points to the northwest. Terminal-side control apparatus 42 sets the upward direction of remote manipulation terminal 32 as the northwest. In other words, remote manipulation terminal 32 is configured to generate target speed signal Vd for moving load W in the azimuth in which suspended-load movement manipulation tool 35 is manipulated to be tilted. At this time, terminal-side control apparatus 42 changes the indication of the azimuth with reference to the upward direction on terminal-side display apparatus 40 to "NW" indicating the northwest.

Figure 5B:
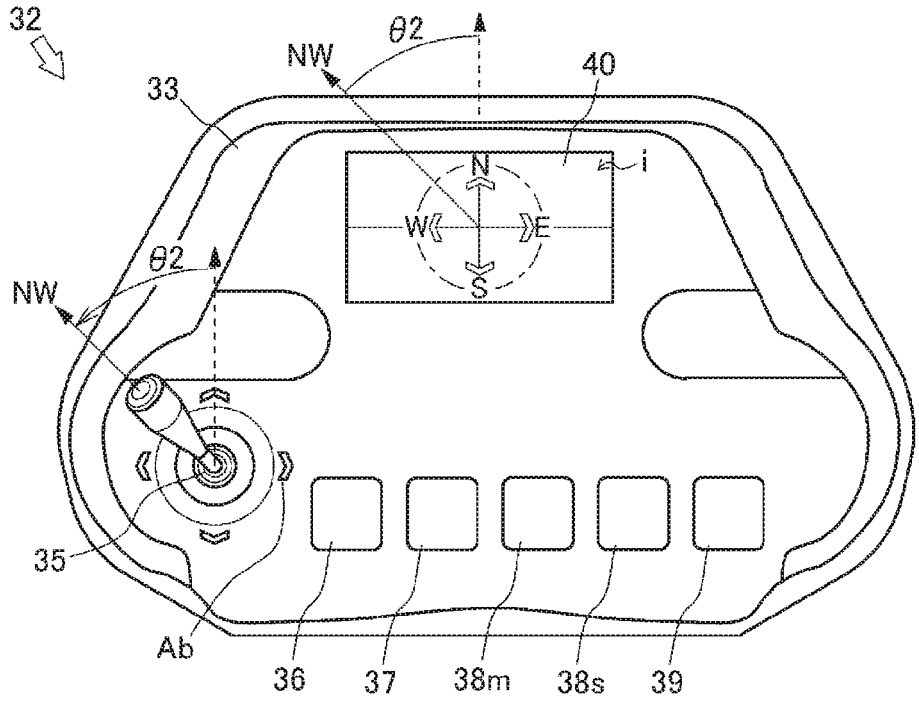
FIG. 5B illustrates an azimuth of a load carried in a case where a suspended-load movement manipulation tool is manipulated.

Based on the manipulation signal for the tilt direction and the tilt amount obtained from suspended-load movement manipulation tool 35 as illustrated in FIG. 5B, terminal-side control apparatus 42 (see FIG. 4) computes, per unit time t, target speed signal Vd composed of the moving direction and the moving speed of load W. For example, when suspended-load movement manipulation tool 35 is manipulated to be tilted in a direction of tilting angle θ2 of 45° that is shifted leftward with respect to the upper direction in a state where the upper direction of remote manipulation terminal 32 is set to the north direction, terminal-side control apparatus 42 computes target speed signal Vd for moving load W at a moving speed corresponding to the tilt amount in the direction that is shifted by θ2=45° to the west from the north. Here, unit time t is any set computation cycle. Terminal-side control apparatus 42 computes target speed signal Vd per unit time t when suspended-load movement manipulation tool 35 is manipulated to be tilted. In the present embodiment, n-th unit time t in the computation cycle after suspended-load movement manipulation tool 35 is manipulated to be tilted is referred to as unit time t(n), and first unit time t after the n-th unit time is referred to as unit time t(n+1). That is, a function of time t is indicated as a function of computation cycle n in the following description.

Next, the control of crane apparatus 6 by remote manipulation terminal 32 will be described with reference to FIG. 6.

Figure 6:
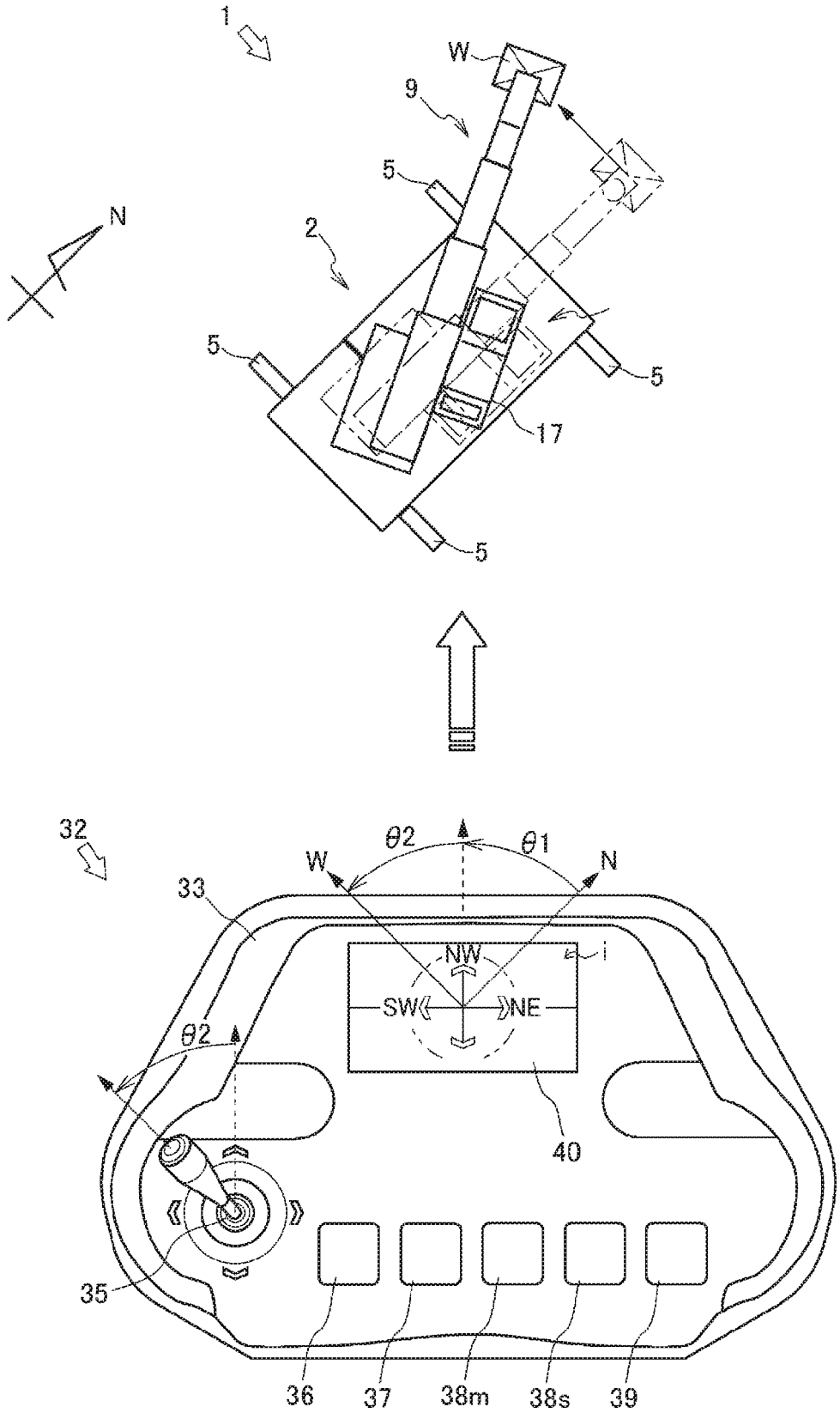
FIG. 6 is schematic diagram illustrating the remote manipulation terminal in which the suspended-load movement manipulation tool is being manipulated and an operating state of the crane during such manipulation.

As illustrated in FIG. 6, when the upper direction of remote manipulation terminal 32 pointing to the north is rotated leftward by θ1=45° (see FIG. 5A), the upper direction of remote manipulation terminal 32 is set to the northwest. When suspended-load movement manipulation tool 35 of remote manipulation terminal 32 is manipulated to be tilted by any tilt amount in a direction shifted leftward by tilting angle θ2=45° from the upward direction, terminal-side control apparatus 42 obtains, from the sensor (not illustrated) of suspended-load movement manipulation tool 35, a manipulation signal for the tilt direction and the tilt amount of the tilt to the west that is the direction shifted by tilting angle θ2=45° from the northwest that is the upward direction. Further, terminal-side control apparatus 42 computes, from the obtained manipulation signal per unit time t, target speed signal Vd for moving load W to the west at a moving speed corresponding to the tilt amount. Remote manipulation terminal 32 transmits computed target speed signal Vd to control apparatus 31 of crane 1 per unit time t.

When crane 1 receives target speed signal Vd per unit time t from remote manipulation terminal 32, control apparatus 31 computes target course signal Pd of load W based on the azimuth of the tip of boom 9 obtained by vehicle-side azimuth sensor 29. Further, control apparatus 31 computes, from target course signal Pd, target position coordinate p(n+1) of load W that represents a target position of the load. Control apparatus 31 generates operation signals Md for swivel valve 23, extension/retraction valve 24, luffing valve 25, main valve 26*m*, and sub valve 26*s* for moving load W to target position coordinate p(n+1). Crane 1 moves load W at a speed corresponding to the tilt amount and to the west that is the tilt direction of suspended-load movement manipulation tool 35. At this time, crane 1 controls hydraulic swivel motor 8, the hydraulic extension/retraction cylinder, hydraulic luffing cylinder 12, the hydraulic main motor, and the like by operation signals Md.

Crane 1 configured as described above obtains target speed signal Vd based on the azimuth from remote manipulation terminal 32 per unit time t and determines target position coordinate p(n+1) of load W based on the azimuth, so that the operator does not lose recognition of the operating direction of crane apparatus 6 relative to the manipulation direction of suspended-load movement manipulation tool 35. In other words, the manipulation direction of suspended-load movement manipulation tool 35 and the moving direction of load W are computed with reference to an azimuth in common. It is thus possible to prevent erroneous manipulation during remote manipulation of crane apparatus 6, and to perform the remote manipulation of the working apparatus easily and simply.

Next, Embodiment 1 of a control process of control apparatus 31 of crane 1 for computing target course signal Pd of load W and target position coordinate q(n+1) of the tip of boom 9 for generation of operation signals Md will be described with reference to FIGS. 7 to 11. Control apparatus 31 includes target-course computation section 31*a*, boom-position computation section 31*b*, and operation-signal generation section 31*c*.

Figure 7:
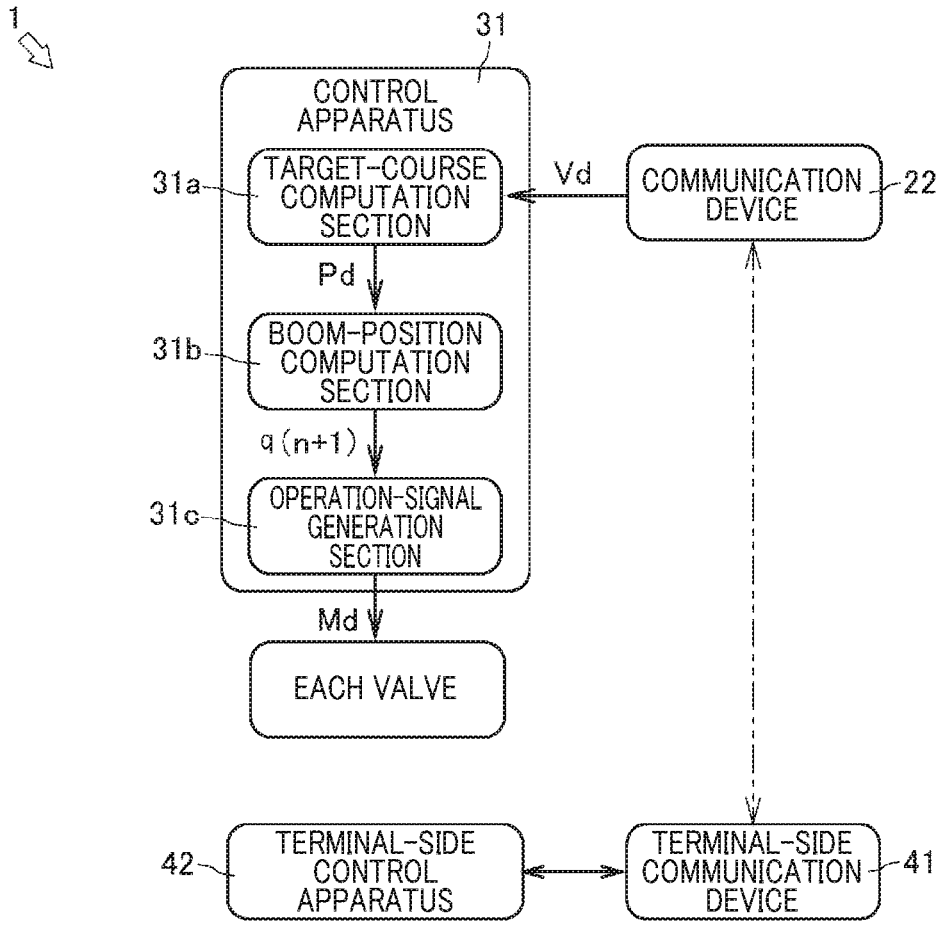
FIG. 7 is a block diagram illustrating a control configuration of a control apparatus of the crane.

As illustrated in FIG. 7, target-course computation section 31*a* is a part of control apparatus 31 and converts target speed signal Vd of load W into target course signal Pd of load W. Target-course computation section 31*a* can obtain target speed signal Vd of load W per unit time t from remote manipulation terminal 32 via communication device 22, the target speed signal being composed of the moving direction and the moving speed of load W. Further, target-course computation section 31*a* is configured to convert, per unit time t, obtained target speed signal Vd into target course signal Pd that is the positional information of load W by applying low-pass filter Lp to the obtained target speed signal.

Low-pass filter Lp is for attenuating a frequency equal to or higher than a predetermined frequency. Target-course computation section 31*a* applies low-pass filter Lp to target course signal Pd to prevent an occurrence of a singular point (abrupt positional change) by differential operation. Although fourth order low-pass filter Lp is used in the present embodiment to deal with a fourth-order differentiation in computation of spring constant kf, it is possible to apply low-pass filter Lp of the order according to desired characteristics. The letters "a" and "b" in Equation 3 are factors.

[3]

$$G(s) = \frac{a}{(s+b)^4} \quad \text{(Equation 3)}$$

Figure 8:
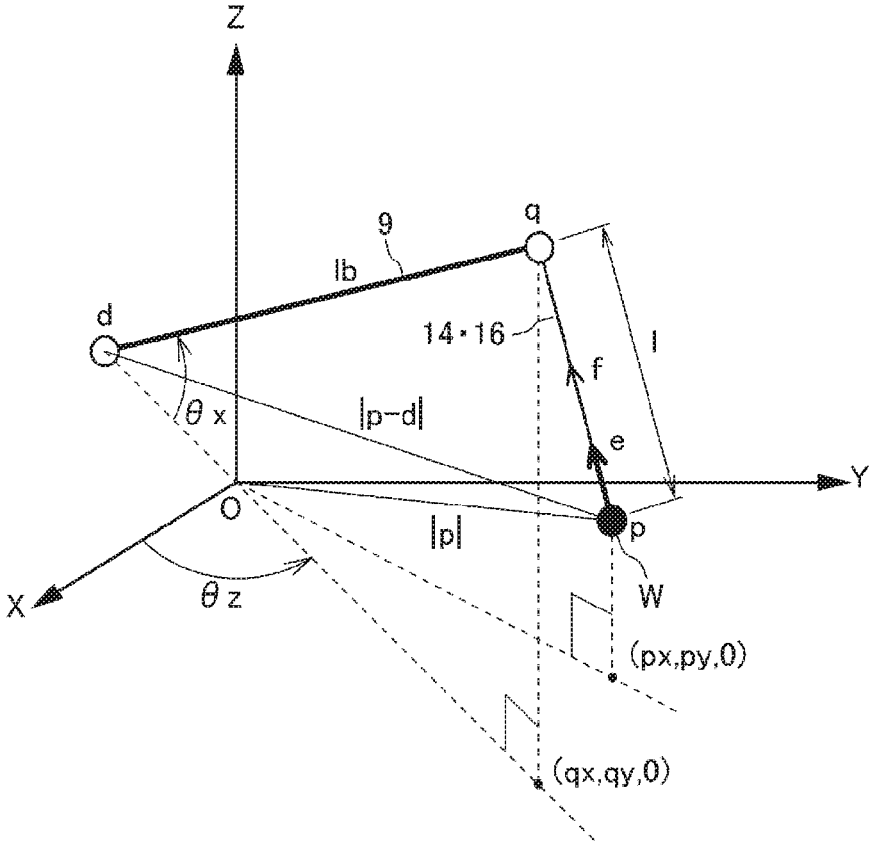
FIG. 8 is a diagram illustrating an inverse dynamics model of the crane.

As illustrated in FIG. 8, an inverse dynamics model of crane 1 is defined. The inverse dynamics model is defined in the XYZ coordinate system in which origin O is the swivel center for crane 1. The letter "q" indicates current position coordinate q(n), for example, and "p" indicates current position coordinate p(n) of load W, for example. The letter "lb" indicates extension/retraction length lb(n) of boom 9, for example. "θx" indicates luffing angle θx(n), for example, and "θz" indicates swivel angle θz(n), for example. The letter "l" indicates let-out amount l(n) of the wire rope, for example, "f" indicates tension f of the wire rope, for example, and "e" indicates direction vector e(n) of the wire rope, for example.

As illustrated in FIGS. 7 and 8, boom-position computation section 31*b* is a part of control apparatus 31 and computes the position coordinate of the tip of the boom from the postural information of boom 9 and target course signal Pd of load W. Boom-position computation section 31*b* can obtain target course signal Pd from target-course computation section 31*a*. Boone-position computation section 31*b* obtains swivel angle θz(n) of swivel base 7 from swivel sensor 27, extension/retraction length lb(n) from extension/retraction sensor 28, luffing angle θx(n) from luffing sensor 30, let-out amount l(n) of main wire rope 14 or sub wire rope 16 (hereinafter, simply referred to as "wire rope") from winding sensor 43, and the current positional information of load W from swivel-base cameras 7*b* (see FIG. 2).

Boom-position computation section 31*b* can compute current position coordinate p(n) of load W from the obtained current positional information of load W, and compute, from obtained swivel angle θz(n), extension/retraction length lb(n), and luffing angle θx(n), current position coordinate q(n) of the tip of boom 9 (i.e., the position at which the wire rope is let out) (hereinafter, simply referred to as "current position coordinate q(n) of boom 9") that represents the current position of the boom tip. Further, boom-position computation section 31*b* can compute let-out amount l(n) of the wire rope from current position coordinate p(n) of load W and current position coordinate Q of boom 9. Furthermore, from current position coordinate p(n) of load W and target position coordinate p(n+1) of load W that represents the target position of load W after the lapse of unit time t, boom-position computation section 31*b* can compute direction vector e(n+1) of the wire rope from which load W is suspended. Boom-position computation section 31*b* is configured to compute, from target position coordinate p(n+1) of load W and direction vector e(n+1) of the wire rope and using the inverse dynamics, target position coordinate q(n+1) of boom 9 that represents a target position of the boom tip after the lapse of unit time t.

Let-out amount l(n) of the wire rope is computed using following Equation 4.

Let-out amount l(n) of the wire rope is defined by the distance between current position coordinate Q of boom 9 that represents the position of the tip of boom 9 and current position coordinate p(n) of load W that represents the position of load W.

(Equation 4)

$$l(n)^2=|q(n)-p(n)|^2 \quad [4]$$

Direction vector e(n) of the wire rope is computed using following Equation 5.

Direction vector e(n) of the wire rope is the vector of tension f (see Equation 1) of the wire rope for a unit length. Tension f of the wire rope is obtained by subtracting the gravitational acceleration from the acceleration of load W computed from current position coordinate p(n) of load W and target position coordinate p(n+1) of load W after the lapse of unit time t.

[5]

$$e(n)=\frac{f}{|f|}=\frac{\ddot{p}(n)-g}{|\ddot{p}(n)-g|} \quad \text{(Equation 5)}$$

Target position coordinate q(n+1) of boom 9 that represents the target position of the boom tip after the lapse of unit time t is computed from following Equation 6 that is Equation 1 expressed as a function of n. Here, "α" indicates swivel angle θz(n) of boom 9.

Target position coordinate q(n+1) of boom 9 is computed from let-out amount l(n) of the wire rope, target position coordinate p(n+1) of load W, and direction vector e(n+1) using the inverse dynamics.

(Equation 6)

$$q(n+1)=p(n+1)+l(n,\alpha)e(t+1)=q(p(n+1),\ddot{p}(n+1),\alpha) \quad [6]$$

Operation-signal generation section 31*c* is a part of control apparatus 31 and generates operation signal Md for each actuator from target position coordinate q(n+1) of boom 9 after the lapse of unit time t. Operation-signal generation section 31*c* can obtain, from boom-position computation section 31*b*, target position coordinate q(n+1) of boom 9 after the lapse of unit time t. Operation-signal generation section 31*c* is configured to generate operation signals Md for swivel valve 23, extension/retraction valve 24, luffing valve 25, and main valve 26*m* or sub valve 26*s*.

Figure 9:
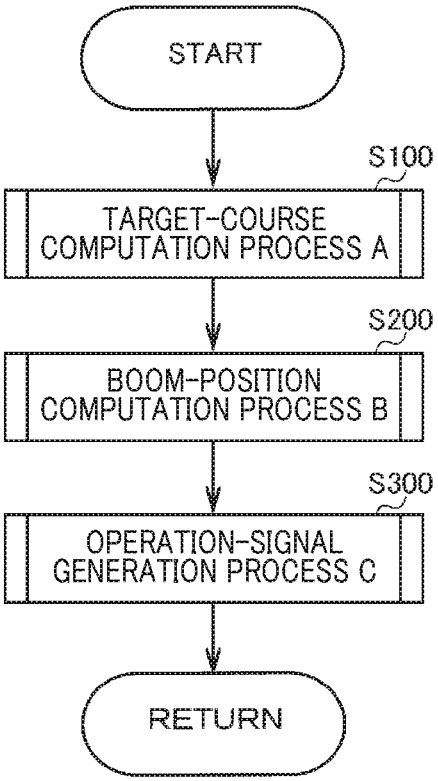
FIG. 9 is a flowchart illustrating a control process of a method of controlling the crane.
Figure 10:
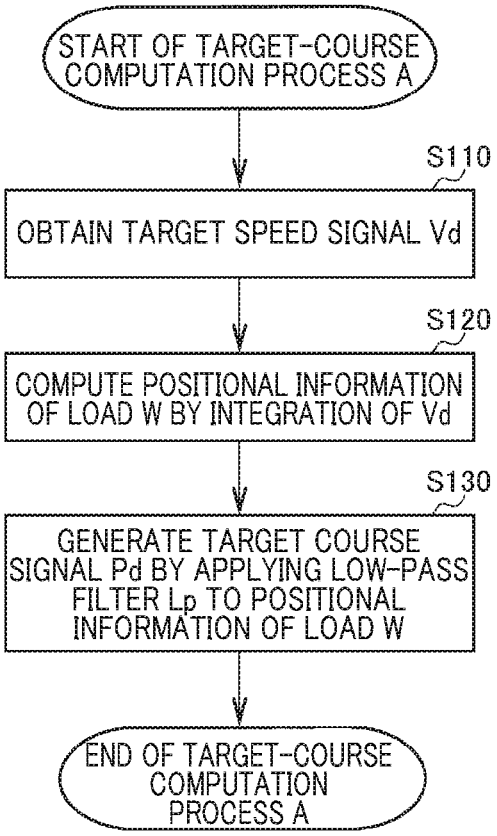
FIG. 10 is a flowchart illustrating a target-course computation process.

As illustrated in FIG. 9, at step S100, control apparatus 31 starts target-course computation process A in the method of controlling crane 1, and the control proceeds to step S110 (see FIG. 10). Then, when target-course computation process A is completed, the control proceeds to step S200 (see FIG. 9).

Figure 11:
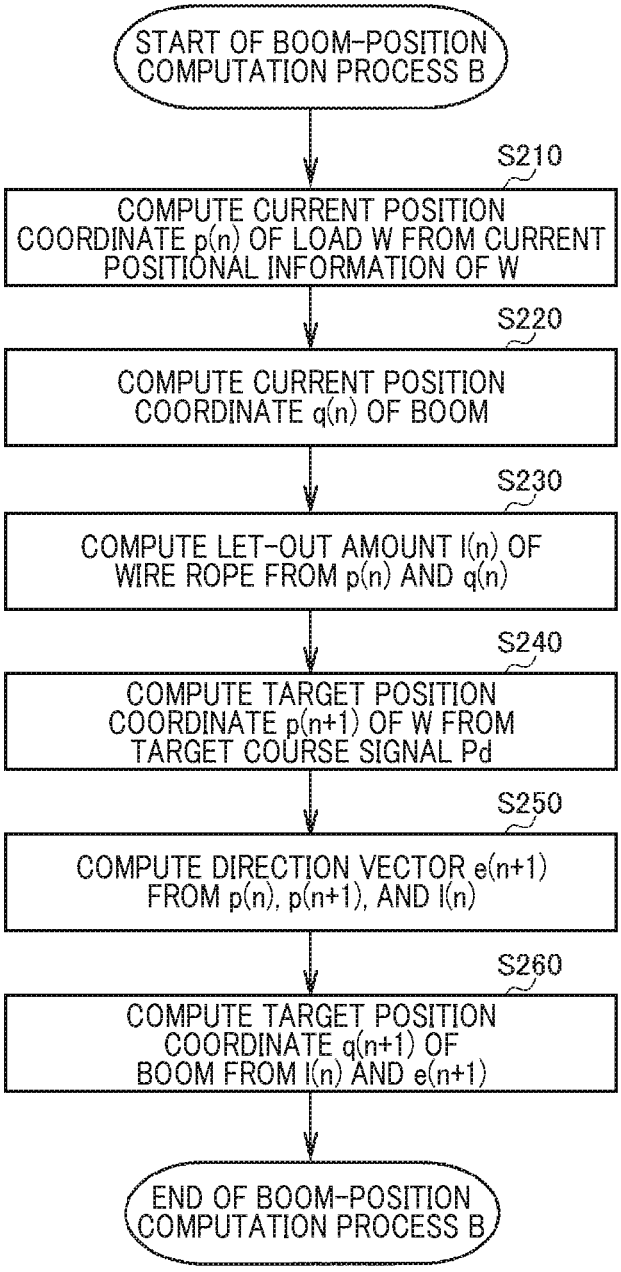
FIG. 11 is a flowchart illustrating a boom-position computation process in Embodiment 1.

At step 200, control apparatus 31 starts boom-position computation process B in the method of controlling crane 1, and the control proceeds to step S210 (see FIG. 11). Then, when boom-position computation process B is completed, the control proceeds to step S300 (see FIG. 9).

Figure 12:
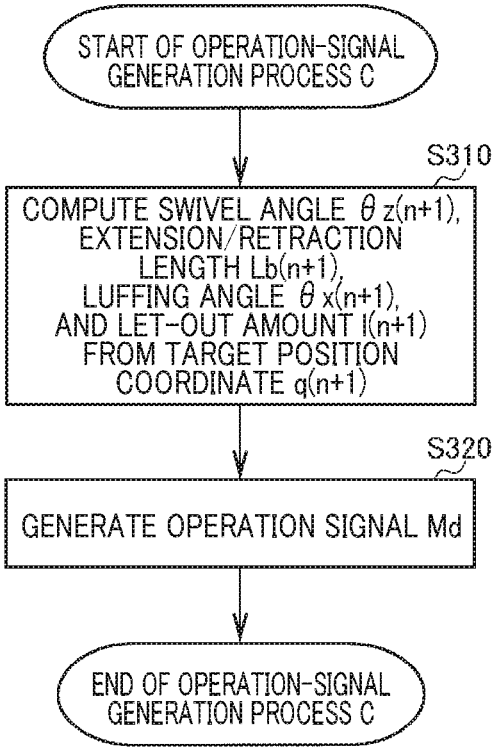
FIG. 12 is a flowchart illustrating an operation-signal generation process.

At step 300, control apparatus 31 starts operation-signal generation process C in the method of controlling crane 1, and the control proceeds to step S310 (see FIG. 12). Then, when operation-signal generation process C is completed, the control proceeds to step S100 (see FIG. 9).

As illustrated in FIG. 10, at step S110, target-course computation section 31*a* of control apparatus 31 obtains target speed signal Vd of load W inputted in the form of a process function from remote manipulation terminal 32, and the process proceeds to step S120.

At step S120, target-course computation section 31*a* computes the positional information of load W by integrating obtained target speed signals Vd of load W, and the process proceeds to step S130.

At step S130, target-course computation section 31*a* computes target course signal Pd per unit time t by applying low-pass filter Lp indicated by transfer function G(s) of Equation 3 to the computed positional information of load W, and ends target-course computation process A. The process then proceeds to step S200 (see FIG. 8).

As illustrated in FIG. 11, at step S210, boom-position computation section 31*b* of control apparatus 31 computes, from the obtained current positional information of load W, current position coordinate p(n) of load W that represents the current position of the load with respect to any determined reference position O (for example, the swivel center for boom 9) serving as the origin, and the process proceeds to step S220.

At step S220, boom-position computation section 31*b* computes current position coordinate q(n) of boom 9 from obtained swivel angle θz(n) of swivel base 7, extension/retraction length lb(n), and luffing angle θx(n) of boom 9, and the process proceeds to step S230.

At step S230, boom-position computation section 31*b* computes let-out amount l(n) of the wire rope using above-described Equation 4 from current position coordinate p(n) of load W and current position coordinate q(n) of boom 9, and the process proceeds to step S240.

At step S240, boom-position computation section 31*b* computes, from target course signal Pd and with reference to current position coordinate p(n) of load W, target position coordinate p(n+1) of load W that represents the target position of the load after the lapse of unit time t, and the process proceeds to step S250.

At step S250, boom-position computation section 31*b* computes the acceleration of load W from current position coordinate p(n) of load W and target position coordinate p(n+1) of load W, and computes direction vector e(n+1) of the wire rope by above-described Equation 5 using the gravitational acceleration, and the process proceeds to step S260.

At step S260, boom-position computation section 31*b* computes target position coordinate q(n+1) of boom 9 using above-described Equation 6 from computed let-out amount l(n) of the wire rope and direction vector e(n+1) of the wire rope, and ends boom-position computation process B. The control then proceeds to step S300 (see FIG. 9).

As illustrated in FIG. 12, at step S310, operation-signal generation section 31*c* of control apparatus 31 computes swivel angle θz(n+1) of swivel base 7, extension/retraction length Lb(n+1), luffing angle θx(n+1), and let-out amount l(n+1) of the wire rope after the lapse of unit time t from target position coordinate q(n+1) of boom 9, and the process proceeds to step S320.

At step S320, operation-signal generation section 31*c* generates operation signals Md respectively for swivel valve 23, extension/retraction valve 24, luffing valve 25, and main valve 26*m* or sub valve 26*s* from computed swivel angle θz(n+1) of swivel base 7, extension/retraction length Lb(n+1), luffing angle θx(n+1), and let-out amount l(n+1) of the wire rope, and ends operation-signal generation process C. The control then proceeds to step S100 (see FIG. 9).

Control apparatus 31 repeats target-course computation process A, boom-position computation process B, and operation-signal generation process C to compute target position coordinate q(n+1) of boom 9, compute direction vector e(n+2) of the wire rope from let-out amount l(n+1) of the wire rope, current position coordinate p(n+1) of load W, and target position coordinate p(n+2) of load W after the lapse of unit time t, and compute target position coordinate q(n+2) of boom 9 after the lapse of another unit time t from let-out amount l(n+1) of the wire rope and direction vector e(n+2) of the wire rope. In other words, control apparatus 31 computes direction vector e(n) of the wire rope, and then successively computes target position coordinate q(n+1) of boom 9 after unit time t from current position coordinate p(n+1) of load W, target position coordinate p(n+1) of load W, and direction vector e(n) of the wire rope using the inverse dynamics. Control apparatus 31 controls the actuators by feedforward control for generating operation signals Md based on target position coordinate q(n+1) of boom 9.

Crane 1 configured as described above computes target course signal Pd based on any target speed signal Vd of load W inputted from remote manipulation terminal 32, so that the speed pattern of the crane is not limited to a prescribed speed pattern. In addition, crane 1 generates the control signal for boom 9 with reference to load W, and the feedforward control for generating the control signal for boom 9 based on the target course intended by the operator is applied in the crane. Thus, in crane 1, a response delay in response to a manipulation signal is small so that a swing of load W due to the response delay is prevented. Further, the inverse dynamics model is constructed, and target position coordinate q(n+1) of boom 9 is computed from direction vector e(n) of the wire rope, current position coordinate p(n+1) of load W, and target position coordinate p(n+1) of load W, so that there is no error that could be caused in the transitional state during acceleration, deceleration, or the like. Furthermore, since the frequency component including the singular point caused by the differential operation for computation of target position coordinate q(n+1) of boom 9 is attenuated, the control of boom 9 is stabilized. It is thus possible to move load W along the target course while reducing the swing of load W, when controlling the actuators with reference to load W.

Next, Embodiment 2 of the control process of control apparatus 31 of crane 1 for computing target course signal Pd of load W and target position coordinate q(n+1) of the tip of boom 9 for generation of operation signals Md will be described with reference to FIGS. 7 to 9. In Embodiment 2, control apparatus 31 computes target position coordinate q(n+1) of boom 9 using spring constant kf of the wire rope. Note that, the control process according to the below-described embodiment is applied to the control process illustrated in FIGS. 1 to 8 instead of a vibration control for an unused hook, and the same components are provided with the same names, reference numerals, and symbols between the control process illustrated in FIGS. 1 to 8 and the control process according to the below-described embodiment. In the following embodiment, the detailed descriptions of the same points as in the already described embodiment will be omitted, and differences between the embodiments will be mainly described.

As illustrated in FIG. 7, control apparatus 31 includes target-course computation section 31*a*, boom-position computation section 31*b*, and operation-signal generation section 31*c*.

As illustrated in FIGS. 7 and 8, boom-position computation section 31*b* is a part of control apparatus 31 and computes the position coordinate of the tip of the boom from the postural information of boom 9 and target course signal Pd of load V. Boom-position computation section 31*b* can obtain target course signal Pd from target-course computation section 31*a*. Boom-position computation section 31*b* obtains swivel angle θz(n) of swivel base 7 from swivel sensor 27, extension/retraction length lb(n) from extension/retraction sensor 28, luffing angle θx(n) from luffing sensor 30, let-out amount l(n) of main wire rope 14 or sub wire rope 16 (hereinafter, simply referred to as "wire rope") from winding sensor 43, and the current positional information of load W from swivel-base cameras 7*b* (see FIG. 2). Boom-position computation section 31*b* is configured to compute, using the inverse dynamics, target position coordinate q(n+1) of boom 9 that represents the target position of the boom tip after the lapse of unit time t from target position coordinate p(n+1) of load W that represents the target position of the load after the lapse of unit time t based on target course signal Pd and from spring constant kf of the wire rope from which load W is suspended.

Spring constant kf of the wire rope is computed using following Equation 1, and target position coordinate q(n+1) of boom 9 is computed using following Equation 2.

A force by gravitational acceleration and a force from crane 1 are exerted on moving load W When the characteristics of the wire rope are expressed by spring constant kf, the equation of motion expressed by following Equation 7 holds for load W.

(Equation 7)

$$m\ddot{p}=mg+k_f(q-p) \quad [7]$$

Let-out amount l of the wire rope can be expressed by following Equation 8. By second-order differentiation of let-out amount l of the wire rope, following Equation 9 is obtained. In Equations 8 and 9, "p" denotes the position coordinate of load W, "q" denotes the position coordinate of boom 9, and "l" denotes the let-out amount of the wire rope.

(Equation 8)

$$l^2=(q-p)^T(q-p) \quad [8]$$

(Equation 9)

$$(q-p)^T\ddot{p}=(q-p)^T\ddot{q}-\dot{l}^2+l\ddot{l}-(\dot{q}-\dot{p})^T(\dot{q}-\dot{p}) \quad [9]$$

Multiplication of Equation 7 expressing the equation of motion of load W by (q−p)T gives following Equation 10. Following Equation 11 expressing spring constant kf is obtained from Equation 10. In Equation 10, "g" denotes the gravitational acceleration, "m" denotes the mass of load W, and "kf" denotes the spring constant of the wire rope.

[10]

$$(q-p)^T\ddot{p}=(q-p)^T\left\{g+\frac{k_f}{m}(q-p)\right\} \quad \text{(Equation 10)}$$

[11]

$$k_f=\frac{m\{(q-p)^T\ddot{q}-\dot{l}^2+l\ddot{l}-(\dot{q}-\dot{p})-(q-p)^Tg\}}{(q-p)^T(q-p)} \quad \text{(Equation 11)}$$

Operation-signal generation section 31*c* is a part of control apparatus 31 and generates operation signal Md for each actuator from target position coordinate q(n+1) of boom 9 after the lapse of unit time t. Operation-signal generation section 31*c* can obtain, from boom-position computation section 31*b*, target position coordinate q(n+1) of boom 9 after the lapse of unit time t. Operation-signal generation section 31*c* is configured to generate operation signals Md for swivel valve 23, extension/retraction valve 24, luffing valve 25, and main valve 26*m* or sub valve 26*s*.

As illustrated in FIG. 9, at step S100, control apparatus 31 starts target-course computation process A in the method of controlling crane 1, and the control proceeds to step S110 (see FIG. 10). Then, when target-course computation process A is completed, the control proceeds to step S200 (see FIG. 9).

Figure 13:
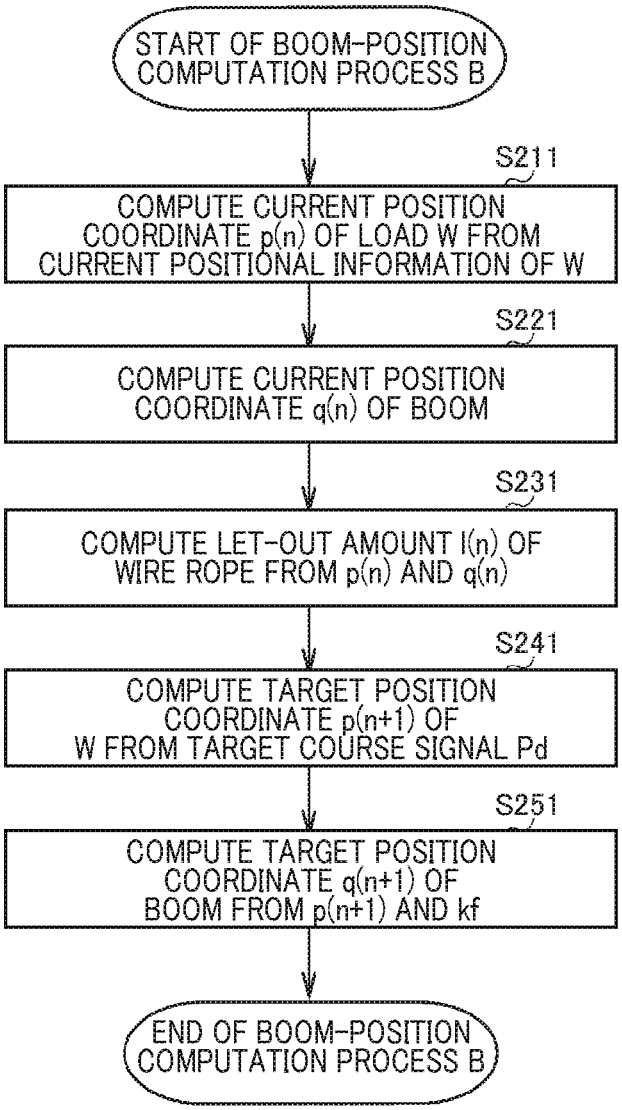
FIG. 13 is a flowchart illustrating a boom-position computation process in Embodiment 2.

At step 200, control apparatus 31 starts boom-position computation process B in the method of controlling crane 1, and the control proceeds to step S210 (see FIG. 13). Then, when boom-position computation process B is completed, the control proceeds to step S300 (see FIG. 9).

At step 300, control apparatus 31 starts operation-signal generation process C in the method of controlling crane 1, and the control proceeds to step S310 (see FIG. 12). Then, when operation-signal generation process C is completed, the control proceeds to step S100 (see FIG. 9).

As illustrated in FIG. 13, at step S211, boom-position computation section 31*b* of control apparatus 31 computes, from the obtained current positional information of load W, current position coordinate p(n) of load W that represents the current position of the load with respect to any determined reference position O serving as the origin, and the process proceeds to step S221.

At step S221, boom-position computation section 31*b* computes, from obtained swivel angle θz(n) of swivel base 7, extension/retraction length lb(n), luffing angle θx(n) of boom 9, and let-out amount l(n) of the wire rope, current position coordinate q(n) of the tip of boom 9 (i.e., the position at which the wire rope is let out) (hereinafter, simply referred to as "current position coordinate q(n) of boom 9") that represents the current position of the boom tip, and the process proceeds to step S231.

At step S231, boom-position computation section 31*b* computes spring constant kf of the wire rope using above-described Equation 11 from current position coordinate p(n) of load W, current position coordinate q(n) of boom 9, let-out amount l(n) of the wire rope, and mass m of load W, and the process proceeds to step S241.

At step S241, boom-position computation section 31*b* computes, from target course signal Pd and with reference to current position coordinate p(n) of load W, target position coordinate p(n+1) of load W that represents the target position of the load after the lapse of unit time t, and the process proceeds to step S251.

At step S251, boom-position computation section 31*b* computes, from target position coordinate p(n+1) of load W and spring constant kf and using Equation 7, target position coordinate q(n+1) of boom 9 that represents the target position of the boom tip after the lapse of unit time t, and ends boom-position computation process B. The process then proceeds to step S300 (see FIG. 9).

Control apparatus 31 repeats target-course computation process A, boom-position computation process B, and operation-signal generation process C to compute target position coordinate q(n+1) of boom 9, compute spring constant kf from let-out amount l(n+1) of the wire rope, current position coordinate p(n+1) of load W, and current position coordinate q(n+1) of boom 9 after the lapse of unit time t, and compute target position coordinate q(n+2) of boom 9 after the lapse of another unit time t from spring constant kf and target position coordinate p(n+2) of load W after the lapse of another unit time t. In other words, the characteristics of the wire rope are expressed as spring constant kf, and control apparatus 31 successively computes, using the inverse dynamics, target position coordinate q(n+1) of boom 9 after the lapse of unit time t from target position coordinate p(n+1) of load W and current position coordinate q(n) of boom 9. Control apparatus 31 controls the actuators by feedforward control for generating operation signals Md based on target position coordinate q(n+1) of boom 9.

Crane 1 configured as described above computes target course signal Pd based on any target speed signal Vd of load W inputted from remote manipulation terminal 32, so that the speed pattern of the crane is not limited to a prescribed speed pattern. In addition, crane 1 generates the control signal for boom 9 with reference to load W, and the feedforward control for generating the control signal for boom 9 based on the target course intended by the operator is applied in the crane. Thus, in crane 1, a response delay in response to a manipulation signal is small so that a swing of load W due to the response delay is prevented. Further, the inverse dynamics model considering the characteristics of the wire rope is constructed, and target position coordinate q(n+1) of boom 9 is computed from spring constant kf of the wire rope and target position coordinate p(n+1) of load W, so that there is no error that could be caused in the transitional state during acceleration, deceleration, or the like. Furthermore, since the frequency component including the singular point caused by the differential operation for computation of target position coordinate q(n+1) of boom 9 is attenuated, the control of boom 9 is stabilized. It is thus possible to move load W along the target course while reducing the swing of load W, when controlling the actuators with reference to load W.

The embodiment described above showed only a typical form, and can be variously modified and carried out within the range without deviation from the main point of one embodiment. Further, it is needless to say that the present invention can be carried out in various forms, and the scope of the present invention is indicated by the descriptions of the claims, and includes the equivalent meanings of the descriptions of the claims and every change within the scope.

INDUSTRIAL APPLICABILITY

The present invention is applicable to a crane and a method of controlling the crane.

REFERENCE SIGNS LIST

1 Crane
6 Crane apparatus
7*b* Swivel-base camera
9 Boom
27 Swivel sensor
28 Extension/retraction sensor
30 Luffing sensor
43 Winding sensor
O Reference position
Vd Target speed signal
p(n) Current position coordinate of load
p(n+1) Target position coordinate of load
q(n) Current position coordinate of boom
q(n+1) Target position coordinate of boom

The invention claimed is:

1. A crane configured to control an actuator of a boom based on a target speed signal related to a moving direction and a speed of a load suspended from the boom by a wire rope, the crane comprising:

a swivel sensor configured to detect a swivel angle of the boom;

a luffing sensor configured to detect a luffing angle of the boom;

an extension/retraction sensor configured to detect an extension/retraction length of the boom;

a load position sensor configured to detect a current position of the load relative to a reference position; and a processor configured to:

convert the target speed signal into a target position of the load relative to the reference position, compute a current position of a boom tip relative to the reference position from a swivel angle detected by the swivel sensor, a luffing angle detected by the luffing sensor, and an extension/retraction length detected by the extension/retraction sensor, compute a let-out amount of the wire rope from the current position of the load detected by the load position sensor and the current position of the boom tip, compute, from the current position of the load and the target position of the load, a direction vector of the wire rope at a timing at which the load reaches the target position, compute a target position of the boom tip for the target position of the load from the let-out amount of the wire rope and the direction vector of the wire rope, and generate an operation signal for the actuator based on the target position of the boom tip.

2. The crane according to claim 1, wherein the processor is further configured to convert the target speed signal into the target position of the load by integrating the target speed signal and attenuating a frequency component in a predetermined frequency range.

3. The crane according to claim 2, wherein a relationship between the target position of the boom tip and the target position of the load is expressed by the following Equation 1 based on the target position of the load, a weight of the load, and a spring constant of the wire rope, and the processor is further configured to compute the target position of the boom tip by the following Equation 2 that is a function of time for the load:

[1]

$$m\ddot{p}g=mg+f=mg+k_f(q-p) \quad \text{(Equation 1)}$$

[2]

$$q(t)=p(t)+l(t,\alpha)e(t)=q(p(t),\ddot{p}(t),\alpha) \quad \text{(Equation 2)}$$

wherein "f" denotes a tension of the wire rope, "kf" denotes the spring constant, "m" denotes a mass of the load, "q" denotes the current position or the target position of a tip of the boom, "p" denotes the current position or the target position of the load, "l" denotes the let-out amount of the wire rope, "α" denotes the swivel angle, and "g" denotes gravitational acceleration.

4. The crane according to claim 1, further comprising:

a remote manipulation apparatus configured to receive manipulation by an operator and generate the target speed signal according to content of the manipulation.

5. A method of controlling a crane comprising a processor and configured to control an actuator of a boom based on a target speed signal related to a moving direction and a speed of a load suspended from the boom by a wire rope, the method performed by the processor and comprising:

converting the target speed signal into a target position of the load;

computing a let-out amount of the wire rope from a current position of the load and a current position of a boom tip relative to a reference position;

computing a direction vector of the wire rope from the current position of the load and the target position of the load;

computing a target position of the boom tip for the target position of the load from the let-out amount and the direction vector of the wire rope; and generating an operation signal for the actuator based on the target position of the boom tip.

* * * * *